US005707299A

United States Patent [19]

McKenna

[11] Patent Number: 5,707,299

[45] Date of Patent: Jan. 13, 1998

[54] LEVEL INDICATING GOLF PUTTER

[76] Inventor: Roger D. McKenna, 6489 Camimito Baltusral, San Diego, Calif. 92007

[21] Appl. No.: 581,469

[22] Filed: Dec. 29, 1995

[51] Int. Cl.[6] ..... A63B 69/36

[52] U.S. Cl. ..... 473/241; 473/341

[58] Field of Search ..... 473/241, 242, 473/341; D21/219

[56] References Cited

U.S. PATENT DOCUMENTS

| | | | |
|---|---|---|---|
| D. 327,930 | 7/1992 | Jazdzyk | D21/219 |
| 2,995,375 | 8/1961 | Bukovey | 473/241 |
| 3,966,210 | 6/1976 | Rozmus | 473/341 |
| 4,082,286 | 4/1978 | La Breche | 473/241 |
| 4,179,125 | 12/1979 | Cone et al. | 473/241 |
| 4,575,090 | 3/1986 | Heseltine | 473/241 |
| 4,824,114 | 4/1989 | Catalano | 473/251 |
| 4,898,387 | 2/1990 | Finney | 473/341 |
| 5,160,142 | 11/1992 | Marshall | 473/241 |
| 5,209,470 | 5/1993 | Cimaroli et al. | 473/241 |

*Primary Examiner*—Mark S. Graham
*Attorney, Agent, or Firm*—Fuess & Davidenas

[57] ABSTRACT

A golf club putter head affixing an elongate spirit level may be tilted relative to earth and rested on its two frustaconical projections so as to accurately measure earth inclination nonetheless that, inter alia, the sole of the putter head is curved, and thus unsuitable to serve to reference the putter head to the earth's surface. The two frustaconical projections are preferably spaced parallel, equal length, maximally separated and axially weighted. The spirit level is preferably both removably affixed—permitting use of the putter in regulation play—and of maximum elongate extent. A preferably offset hostel is affixed in a position preferably substantially midway between maximally-separated spaced-parallel frustaconical projections.

2 Claims, 2 Drawing Sheets

LEVEL INDICATING GOLF PUTTER

BACKGROUND OF THE INVENTION

1. Field of the Invention

The present invention generally concerns golf clubs, and particularly golf club heads, and more particularly the head of a golf putter.

The present invention further concerns golf club putter heads incorporating a spirit level so when the putter is placed on a golf green with its spirit level alternately (i) in alignment with, and (ii) transverse to, the direction of golf ball travel towards the hole, then the spirit level will indicate the direction, and the magnitude, of the compensation that a golfer should make during a putt in order to account for the slope of the green in directions both (i) towards the hole, and (ii) transverse, to the direction of ball travel.

2. Description of the Prior Art

It is known to incorporate a spirit level in a golf club, and particularly in the head of a putter, in order to indicate the inclination of a golf green when the putter is placed on a golf green. The putter head spirit level may be placed in alignment with the direction of golf ball travel towards the hole in order to indicate the slope of the green in that direction. The force of the putting stroke is normally modified in accordance with whether or not the path of the golf ball towards the hole is either uphill or downhill. The putter head spirit level may alternatively be placed transversely to the direction of golf ball travel towards the hole in order to indicate the slope of the green in that direction. The spirit level will then indicate the direction, and the magnitude, of any offset in the direction of the putt that a golfer should make in order to account for the slope of the green transverse to the direction of ball travel.

The spirit level serves to indicate slope relative to geophysical flat. The indication of slope serves to inform the golfer of the (i) direction, and (ii) magnitude of any compensation that should be made for the slope of the green before the putting stroke, and may additionally, in some prior art embodiments, be used to guide the orientation of the club head relative to flat during the putting stroke.

U.S. Pat. No. 2,919,922 to Skelly for a GOLF CLUB shows a gulf club, particularly a golf putter, incorporating a liquid level indicator in the putter head. The usage of such liquid level is taught as permitting the golf club head to be held in a horizontally level position during a putting stroke.

U.S. Pat. No. 2,923,552 to Sundberg for a GULF PUTTING COORDINATOR DEVICE shows a spirit level much in the matter of the Skelly golf club. The spirit level is preferably in the shape of a shallow U-shape tube, and is magnetically affixed to the rear side of a golf club head, particularly a putter head. A ball within the U-shape tube moves during the course of a golf club swing in response to centrifugal force. This movement may be damped by the presence of fluid in the tube. If the arc of the swing is optimal, then the ball will remain substantially centered between lines drawn on the tube.

Similarly to the purposes of the Sundberg invention in guiding the performance of the golf swing, U.S. Pat. No. 2,976,046 to McCullough, Jr. for a GOLF CLUB is also directed to a permanent spirit level formed integrally with a head of a golf club or a putter. The base of the club head is flat in order to permit the spirit level to give an accurate indication of inclination when the club head is positioned along the line of a perspective putting stroke.

U.S. Pat. No. 2,995,375 to Bukovey for a GOLF CLUB likewise shows a golf club, particularly a putter, head incorporating a spirit level. The bottom of the putter head has a straight edge which is intended to be variously placed along several imaginary lines joining the golf ball and regions at, and approximate to, the cup. By observation of the level indications the slope of the green in several directions may be determined. Usage of the incorporated level for the adjustment of the hand club position during the putting stroke is also shown.

U.S. Pat. No. 3,429,576 to Ikeda for a GOLF CLUB HAVING LEVEL INDICATING MEANS AND WEIGHT MEANS shows a putter head having both a level and a dead weight. The level indicates club head orientation. Meanwhile, the weight adjusts the swing dynamics of a number of separate club heads to be the same when each in turn selectively fitted to a common shaft.

U.S. Pat. No. 3,909,004 to Vella for a PUTTER HAVING CIRCULAR LEVEL shows and describes a putter with a two dimensional spirit level. By observation of the level, the orientation of the shaft relative both to horizontal, and to vertical, may be observed. The bottom, or sole, plate of the putter is rounded, potentially to facilitate ready angular orientation of the spirit level to flat.

U.S. Pat. No. 4,082,286 to La Breche for a DIRECTION AND SLOPE INDICATING PUTTER HEAD shows a putter head with a spirit level and a scale. The displacement of the bubble indicator within the spirit level may read against a scale which, in consideration of the distance of the prospective putt in feet, indicates the expected break of the stroke gulf ball in inches at the distance of the hole.

U.S. Pat. No. 5,160,142 to Marshall for a GULF PUTTING TRAINING DEVICE shows a gulf club having both a spirit level and a number of angularly disposed pockets into which a small contained ball will role during the putting stroke. The bubble indicator of the spirit level indicates the angular orientation of the club head during addressing of the gulf ball, whereas the pocket within which the contained ball comes to rest serves to indicate whether the putter blade was held square with the intended line of putt during the actual putting stroke.

U.S. Pat. No. 4,824,114 to Catalano for an GULF PUTTER WITH SLOPE INDICATING MEANS THEREIN discloses a golf club incorporating a particular level which, when a club is placed on the green prior to a putting stroke, operates as a pendulum, or plumb bob, in order to determine, and to indicate, the angle of the putting green from horizontal. The indicating face of the level is of a particular type, being substantially opaque with a clear circular central window though which a pendulum may be viewed. A circular indicia on the pendulum is the same size as the window. The displacement of this indicia relative to the window indicates the inclination angle of the ball path.

U.S. Pat. No. 5,209,470 for a GOLF GREEN SLOPE READING LEVEL shows a golf club head incorporating a spirit level which may be viewed by retracting a sliding window. The spirit level is positionable, with the help of indicia marked on the club head, in order to assess the slope of the green.

The preferred embodiment of the present invention will be seen to possess a distinct form which supports of its functional purposes. Although there is no suggestion in the prior art of the use of such a form in combination with a spirit level, nor for the purposes to which such form is put by Applicant, certain golf club putter heads—which tend to have diverse forms in any case—resembling the preferred form of Applicant's putter head have previously been constructed. For example, design U.S. Pat. No. 326,696 for a GOLF PUTTER HEAD and U.S. Pat. No. 327,930 for a GOLF PUTTER HEAD both show golf club putter heads having dual rearward-extending protuberances, as will be seen to be typical of Applicant's putter head.

Previous combinations of a golf club, particularly a golf putter, club head with a spirit level suffer certain limitations. Generally, the club head must either be somewhat arbitrarily shaped in having an elongate straight surface, normally a sole plate, that is positionable upon and co-parallel with the surface of the green, or else suffer some inaccuracy in the measurement of inclination angle. Since the inclination angle indicated by the spirit level normally is, and should be, accurate to a fraction of a degree, it is desirable that the club head and its incorporated spirit level should be susceptible of regular, repetitive, placement in order to give consistent measurements with a high degree of accuracy and repeatability. However, with the existing club, and putter, head designs this is not always the case; particularly because one or more surfaces, and particularly the sole plate of the putter head, may be rounded—as is a common style of construction for golf club putters.

Accordingly, it would be desirable if a golf club putter head incorporating a spirit level was not mandated to either have an extensive straight sole plate or else suffer angular measurement inaccuracies from the absence thereof.

Another limitation exists in that the levels of prior art golf clubs are not removable, thereby disqualifying the use of any club to which the head is fitted during regulation play (as determined by the rules of the United States Golf Association). Although a player may practice with one putter and engage in competition play with another, it would much be preferred if a single putter could, at different times, serve both the purposes of training device and a club that was in conformance with the rules of golf.

Finally, some of the prior art devices, such as, notably, the golf putting coordinator devices of U.S. Pat. Nos. 2,923,552 and 5,160,142 are concerned with permitting a golfer to recognize any angular mis-orientation of the club head during the performance of the putting stroke. Nonetheless to providing such indications, the distribution of mass in the heads of the clubs so indicating does nothing to improve the dynamics of the stroke. At least in a practice club, and particularly a putter, it would be desirable that any mis-orientation of the club should be, insofar as possible, not only visually, but also tactilely, indicated to a golfer. It would also be desirable if it was somehow more difficult, even if only slightly so, to place the club in a misoriented position. By repeated performance of a putting stroke with a proper putter head orientation, and with a proper putting stroke, a golfer could gain confidence and learn the "feel" of successfully holding and guiding the putter during the putting stroke.

SUMMARY OF THE INVENTION

The present invention contemplates a golf club head, particularly a putter head, incorporating an elongate spirit level that is both (i) referenced in position relative to the apexes of two protuberances extending rearward from the golf club head, and (ii) selectively removable and replaceable. The present invention further contemplates a level-indicating putter head where large dense masses are distributed (i) at peripheral heel and toe regions of the putter, and (ii) into rearward-extending protuberances, so as to increase the moment of inertia of the putter head to angular rotation.

In the preferred embodiment of a level-indicating golf putter, an elongate spirit level has and defines an axis, and continuously indicates both the (i) direction and (ii) angle of any inclination of this axis relative to local geophysical flat, which geophysical flat is orthogonal to the local gravity vector. In accordance with the present invention, the axis of the spirit level is positionable relative to the true local slope of the earth (the green) along any directional line nonetheless that the shape of the body of the golf club, or putter, head in which the spirit level is incorporated is substantially unconstrained.

The golf club, or putter, head may, in particular, replicate the substantial form of almost all the diverse kinds of putter heads—save only that accommodation must be made to (removably) mount the level, and (at least) two rearward-extending protuberances are incorporated. Further in particular, the body of the golf club, or putter, head need not have any of (i) a sole or sole plate, (ii) a heel portion and/or a toe portion, (ii) a top portion and/or a bottom portion, and/or (iii) a rear portion and/or even a face portion that are any of (1) planar, (2) straight, and/or (3) aligned parallel with the axis of the elongate spirit level. Veritably any shape head will suffice. The head may be, for example and as an extreme example, substantially in the shape of an ellipsoid, or perhaps an ellipsoid with a small flat surface for striking the golf ball.

There is, however, one particular feature on the body of the golf club head with which feature the axis of the spirit level is in alignment, and is in particular co-parallel. The golf club head has and presents to the rearward two protuberances on its rear surface (opposite to a face surface with which a golf ball is struck). The apexes of these protuberances are susceptible of being connected by an imaginary line that does not otherwise intersect the club body. In other words, the two protuberances extend rearward from the club body further than any other feature(s). The imaginary line connecting the apexes of the two protuberances is co-parallel to the axis of the spirit level.

In operational use, the club body is tilted, normally by a human golfer holding and manipulating the handle of a golf club to which the club body is affixed, so that the club head comes to rest momentarily on the two apexes of its two rearward protuberances, only. When so resting the club body, and the spirit level affixed thereto, are spatially aligned in angular attitude relative to flat. The axis of the spirit level is aligned in azimuthal direction with the imaginary line between the two apexes.

When these two apexes are positioned along an imaginary line directed towards the cup, or hole, of a golf putting green (into which hole the golfer desires to put the golf ball), then the spirit level will read the angular orientation of the golf club head relative to flat in the direction of the hole. This angular orientation is, or course, also the slope of the putting green along the line-of-sight between the golf club head and the hole.

Alternatively, when these two apexes are positioned transversely to the imaginary line directed towards the cup, or hole, then the spirit level will read the angular orientation of the golf club head relative to flat in the direction transverse to the direction of the hole. This angular orientation is, or course, also the slope of the putting green transverse to the line-of-sight between the golf club head and the hole.

The club head may be swiveled upon an apex of a one of its two rearward-extending protuberances, the remaining apex being momentarily touched to the surface of the green at various azimuthal orientations. By this process the angular elevation of the green surface in a number of different directions may be readily determined.

The spirit level is preferably removable. The preferred golf club without its included level may be used in regulation play under the United States Professional Golfers Association (USPGA) rules of golf.

The spirit level is preferably co-extensive in length with a longest, heel to toe, length of the golf club head. In this manner the level is optimally sensitive to the smallest angles of tilt and inclination, and these small angles may also be made clearly visible.

The golf club head is preferably made of material of a first density in regions distant from imaginary axis of two maximally-separated spaced-parallel frustaconical protuberances, and of a material of a second density, greater than and normally much greater than, the first density, in regions proximate to the imaginary axis of the two maximally-separated spaced-parallel rearward-extending frustaconical protuberances. Additionally, in the preferred embodiment the rearward-extending frustaconical protuberances are sizable, while the connective structure between them, including the face plate and sole plate of the golf club, is de minimis. By this construction most of the weight of the golf club head is within its heel and its toe regions. Ergo, these are "weighted regions".

The hostel, or point of shaft connection to the golf club head, is between, and is preferably approximately midway between, the heel and toe regions of the body of club head. By this construction the moment of inertia of the club head body about the club shaft (or any axis intersecting an imaginary plane between the weighted regions imaginary axis at a location between the weighted regions) is increased over what the moment of inertia would be should the club head body have been made of material of homogenous density.

The increased moment of inertia makes the golf club head harder to rotate, or turn, or twist, about the shaft. This increased moment of inertia promotes that, the flat striking face of the club head having once been positioned orthogonal to a line of club head motion during a putting stroke, it will thereafter better preserve this orthogonal relationship, and will cause a struck golf ball to move in a linear extension of the line of club head motion at the point of impact.

These and other aspects and attributes of the present invention will become increasingly clear upon reference to the following drawings and accompanying specification.

DESCRIPTION OF THE PREFERRED EMBODIMENT

Figure 1:
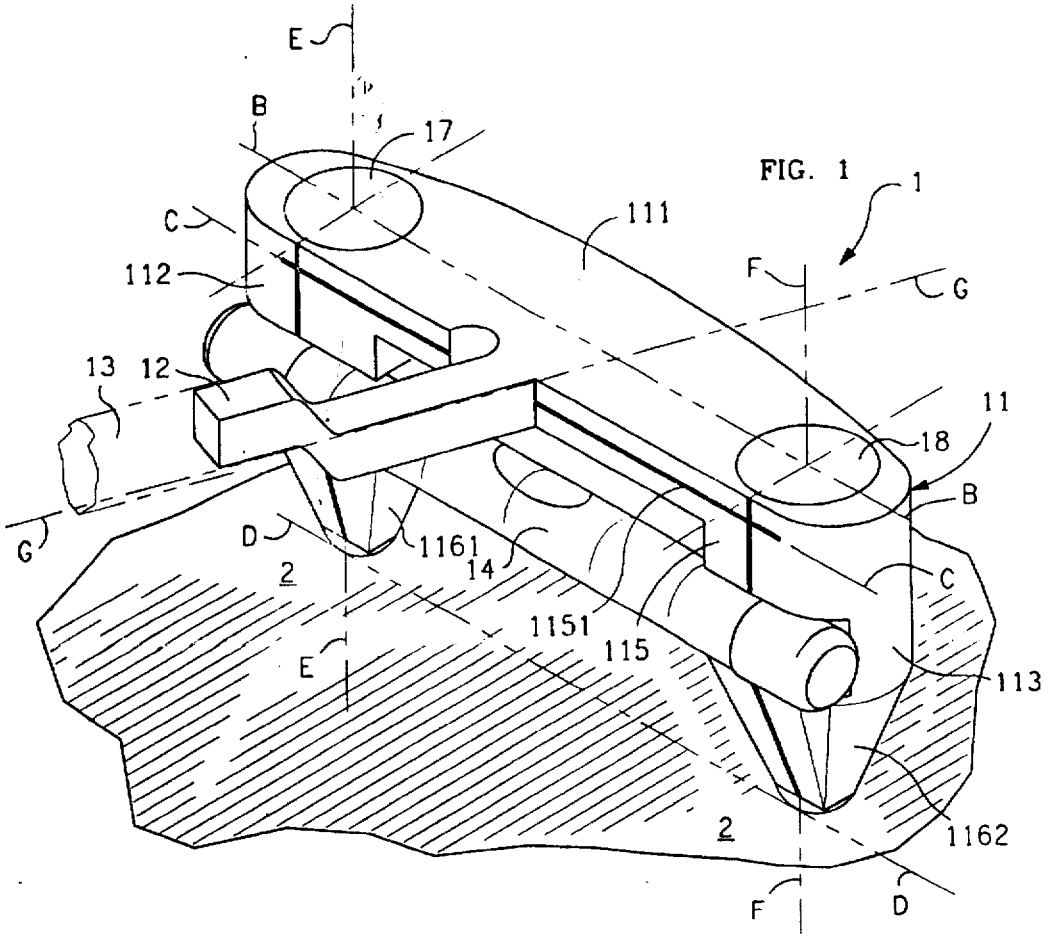
FIG. 1 is a diagrammatic perspective view showing a preferred embodiment of the head of a level-indicating golf putter in accordance with the present invention in operational use to indicate the angular orientation of a surface, normally a golf green, upon which it rests on two rearward-extending protuberances.
Figure 3:
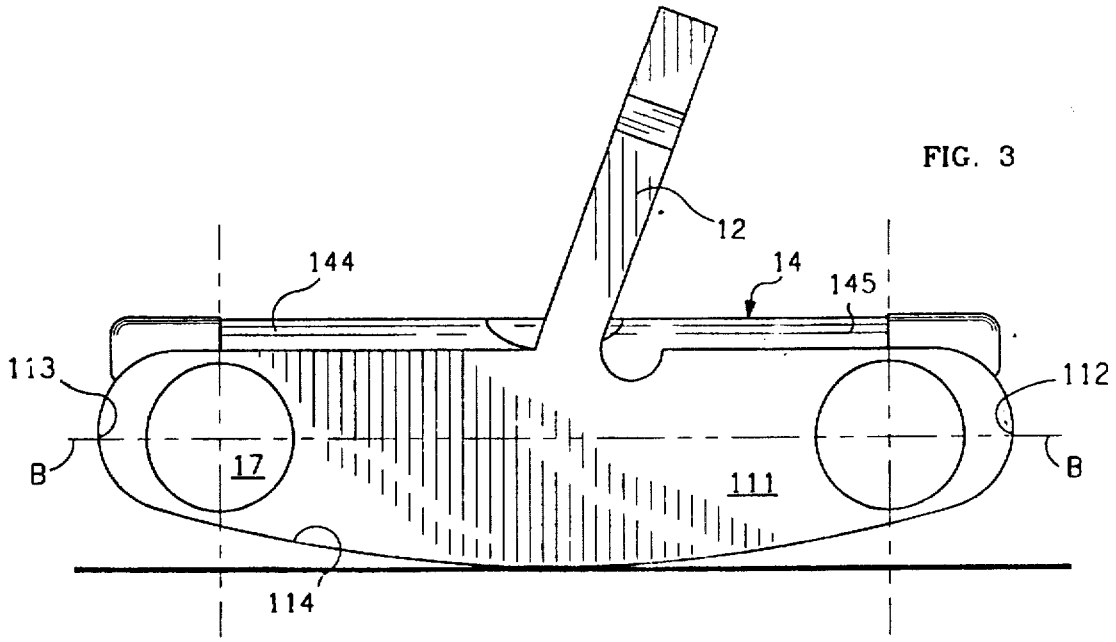
FIG. 3 is a front plan view of the preferred embodiment of the head of a level-indicating golf putter in accordance with the present invention previously seen in FIGS. 1 and 2.
Figure 4:
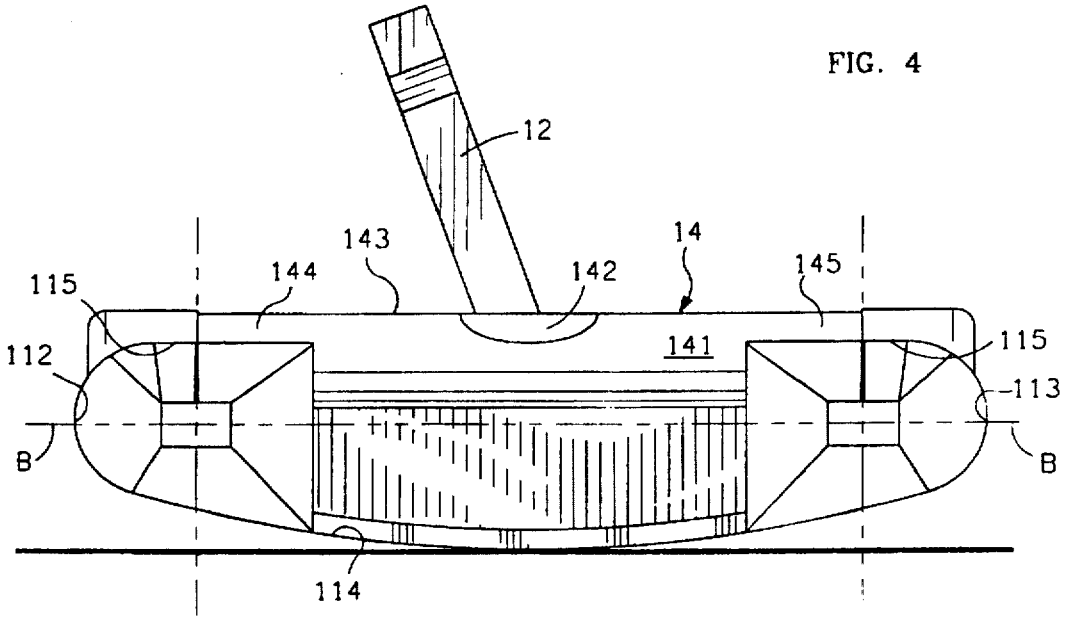
FIG. 4 is a rear plan view of the preferred embodiment of the head of a level-indicating golf putter in accordance with the present invention previously seen in FIGS. 1 through 3.

A preferred embodiment of the head 1 of a level-indicating golf putter in accordance with the present invention is shown in operational use in the diagrammatic perspective vies of FIG. 1. The same embodiment of the head 1 is variously shown in top, front and rear plan views in FIGS. 2–4.

The head 1 includes a head body 11 that includes a front face 111, a heel region 112, a toe region 113, a sole 114 (best seen in FIGS. 3 and 4), a top surface 115 and a relatively complex rear side region 116. A hostel 12 connects a club shaft 13 (shown in phantom line in FIG. 1) to the body 1, preferably at a position proximate to the front face 111 and midway along the longitudinal length of the club head 1, and its face 11, between the heel region 112 and the toe region 113. The hostel 12 is preferably offset, as illustrated, in order that the shaft 13 may be in better alignment with the surface of a golf ball (not shown) as such as addressed for putting by the club head 1.

In accordance with the present invention, the club head 1 mounts a level, preferably a spirit level 14. The spirit level 14 normally consists of an environmentally benign colored liquid, normally colored water 141, along with a trapped air bubble 142, inside an (effectively) unbreakable clear plastic sealed tube 143. The tube 143 is capped at each end with resilient plastic end caps 144, 145. The spirit level 14 with its end caps 144, 145 fits into, and is compressively frictionally retained within, a complimentary cavity located within the top surface 115, roughly midway between the face 111 and the furthest rearward extension of the rear surface 116, of the club head body 11. The spirit level 14 may be selectively removed from, and re-inserted into, this mounting cavity under force of the fingers. When inserted into its cavity, the spirit level 14, and its longitudinal axis A—A, are accurately positionally registered and aligned relative to the club head body 11 within 1° of arc.

The length of the spirit level 14, and the corresponding length of the cavity of the club head body 11 in which cavity it is selectively lodged, is preferably as long as is practical. This makes that the inaccuracies of mounting are minimized simultaneously that the sensitivity of, and the length of a scale (not shown), on the spirit level 14 are maximized. The amble size of the spirit level 14 also facilitates removal, insertion, and reading of its scale (not shown).

The longitudinal axis A—A of the spirit level 14 is parallel with many other axis and surfaces of the club head body 11. It is, for example, parallel with axis B—B that is located centrally upon and across the flat face 111, and with axis C—C that is coincident with a scribe mark 1151 that is upon the top surface 115, of the club body 11. (The scribe marks 1151, 1152 and 1153 aid a golfer in visually aligning the putter head 1 relative to a golf ball (not shown)). Curiously, however, and although it takes some visualization to imagine, the longitudinal axis A—A of the spirit level 14 need not be parallel with either of the axis B—B or C—C, nor with most of the other generally regular and symmetric features of the club body 11 upon which the spirit level 14 is mounted. Consider, for example, that the sole 114 is curved. This is the exact surface that is normally long and straight in the previous implementations of golf club heads incorporating levels, this straight sole surface serving as a reference for the level.

Figure 2:
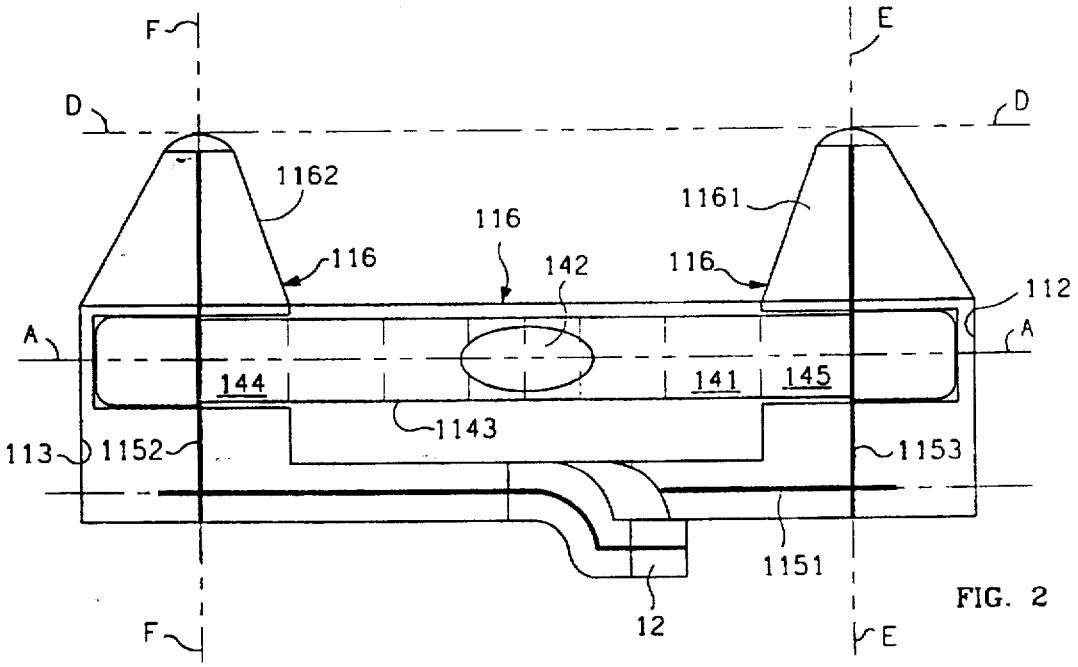
FIG. 2 is a top plan view of the preferred embodiment of the head of a level-indicating golf putter in accordance with the present invention previously seen in FIG. 1.

Instead, in accordance with the present invention, the longitudinal axis A—A of the spirit level is, and must be, parallel with (only) the imaginary axis D-D extending between the apexes of two frustaconically-shaped protuberances 1161, 1162 extending rearward from the rear face 116 of the club head body 11 (as may be most clearly observed in FIG. 2).

In accordance with the present invention, these rearward-extending frustaconically-shaped protuberances 1161, 1162 extend further from the club face 111 than do any other portions of the rear surface 116. The protuberances 1161, 1162 taper to apexes; which apexes may, however, be truncated. The imaginary axis D—D is defined between the apexes of the protuberances 1161, 1162. The protuberances 1161, 1162 are preferably in the shape of frustrums, and more preferably in the shape of truncated frustrums, and even more particularly in the shape of identical truncated frustrums of a square cross-section, ergo truncated pyramidal-shaped bodies.

In accordance with the present invention, the club head 1 may be positioned in its body 11, its level 14, and all its other parts so that the apexes of the protuberances 1161, 1162 rest on the ground 2, as is particularly illustrated in FIG. 1. At this time the axis A—A of the spirit level 14 will, being parallel to the axis D—D between the apexes of the protuberances 1161, 1162, also be parallel to the surface of the ground 2 in a line 2—2 drawn along the ground 2 between the points of contact to the apexes. The air bubble 142 within the spirit level 14 will then indicate, both by the direction and the amount of its displacement from center, the (i) direction and the (ii) magnitude of the angular slope of the ground 2 along the line 2—2. The ground 2 is normally a golf green, and the line 2—2 is normally chosen by the golfer as either a first vector directed towards the hole, or as an alternative, second, vector directed perpendicular to the first vector. By positioning the club head 1 in two orientations—if desired by conveniently pivoting the club head body 11 about a one of the apexes of the protuberances 1161, 1162, as remains upon the surface of the ground 2—the slope of various lines 2—2 may be conveniently indicated. The spirit level 14 is commonly possessed of a circumferential scale (not shown) in order to facilitate an accurate, and a quantitative if desired, assessment of angle relative to geophysical flat (i.e., perpendicular to the local gravity vector).

Still further in accordance with the present invention, the club head body 11 of the level-indicating putter head 1 is preferably not homogenous in construction, but rather incorporates large and dense masses 17, 18. A first mass 17 is distributed interior to the club head body 11 from the front face 111 into the substantial portion of the protuberance 1161, thus making that this mass 17 is near the periphery of the heel region 112 of the club head body 11. A second mass 18 is also distributed interior to the club head body 11, now from the front face 111 into the substantial portion of the protuberance 1162, thus making that this mass 18 is thus near the periphery of the toe region 113 of the club head body 11. Each of the masses 17, 18 is, preferably for aesthetic reasons, centered along a respective central axis E—E, F—F of the respective protuberances 1161, 1162—although this need not invariably be the case. The club head body is normally of a forged metal, typically steel, while the insert masses 17, 18 are typically of lead.

The masses 17, 18 in their locations distributed near the periphery of the heel region 112 and toe region 113 of the club head body 11, and of the putter head 1, serve to increase the moment of inertia of the putter head to angular rotation about any (imaginary) axis that has a component normal to an imaginary plane between the center line of gravity of each of the two masses 17, 18. In other words, the imaginary plane between the center of gravity lines of the two masses 17, 18 would, for example, include the imaginary axis, or lines, B—B and D—D—as may respectively be most easily observed in FIGS. 3 and 4. The putter head 1 will experience an increased moment of angular rotational inertia about any imaginary axis, or line, that is not in this plane.

Note next that an imaginary axis G—G of the hostel 12, and any similar parallel axis (not shown) of the shaft 13, are very nearly perpendicular to the imaginary plane of axis B—B and D—D. The masses 17, 18 have a very substantial moment arm about this axis G—G. Namely, the distance of this moment arm is maximized. Moreover, the distribution of mass along this moment arm is also substantially maximized, being most substantially located at the end of the moment arms. Accordingly, the angular rotational moment of inertia of the putter head 1 about the axis G—G, and, equivalently, about the axis (not shown) of the shaft 13, is substantially maximized.

This high moment of inertia imparts angular stability to the putter head 1 during the putting stroke.

In accordance with the preceding explanation, certain variations and adaptations of golf club and putter heads in accordance with the present invention will suggest themselves to a practitioner of the sporting equipment design arts. For example, the outward form of the club head body 11 can be significantly altered without departing from the principles of rearward extending protuberances, and removable spirit level, and/or unequal axial weighting.

In accordance with these and other possible variations and adaptations of the present invention, the scope of the invention should be determined in accordance with the following claims, only, and not solely in accordance with that embodiment within which the invention has been taught.

What is claimed is:

1. A golf club putter head comprising:

a body member having and defining an elongate flat planar face, a sole that lies in a curved surface everywhere perpendicular to the plane of the face, and two spaced-parallel equal-length frustaconical projections each having a central axis and extending perpendicularly oppositely to the planar face at maximum separation along the elongation of the face;

a spirit level affixed to the body member along an imaginary first axis that is spaced-parallel to both an imaginary line between apexes of the frustrums of the two frustaconical projections and to the planar face, the spirit label extending for substantially the entire length of the body member;

an attachment means for releasibly affixing the spirit level to the body member; and a hostel affixed to the body member in a position substantially midway between the maximally-separated spaced-parallel frustaconical projections;

wherein at such times as the body member is tilted so that only the apexes of the frustrums of its two frustaconical projections contact a surface of the earth, then the spirit level indicates the inclination of the imaginary line between these apexes of the two frustrums, and thus the slope of the earth's surface along this imaginary line.

2. The golf club putter head according to claim 1 wherein the body member comprises:

material of a first density in regions distant from each central axis of the two maximally-separated spaced-parallel frustaconical projections; and material of a second density, greater than the first density, in regions proximate to each central axis of the two maximally-separated spaced-parallel frustaconical projections.

* * * * *